US007225639B2

(12) United States Patent
Flaviano

(10) Patent No.: US 7,225,639 B2
(45) Date of Patent: Jun. 5, 2007

(54) EXPANDABLE RING DESIGN AND METHOD FOR MAKING SAME

(75) Inventor: Callegher Flaviano, Treviso (IT)

(73) Assignee: Kobi Katz Inc., Los Angeles, CA (US)

( * ) Notice: Subject to any disclaimer, the term of this patent is extended or adjusted under 35 U.S.C. 154(b) by 0 days.

(21) Appl. No.: 10/307,820

(22) Filed: Dec. 2, 2002

(65) Prior Publication Data

US 2004/0103688 A1 Jun. 3, 2004

(51) Int. Cl.
*A44C 9/02* (2006.01)

(52) U.S. Cl. ..... 63/15.45; 63/15.5; 63/5.1; 63/6

(58) Field of Classification Search ..... 63/15, 63/15.45, 15.5, 15.65, 5.1, 5.2, 11, 45, 15.6, 63/6

See application file for complete search history.

(56) References Cited

U.S. PATENT DOCUMENTS

| | | | | | |
|---|---|---|---|---|---|
| 255,610 | A | * | 3/1882 | Faas | 63/6 |
| 304,579 | A | * | 9/1884 | Sussman | 63/15.5 |
| 331,033 | A | * | 11/1885 | Chadwick | 63/11 |
| 1,099,810 | A | * | 6/1914 | Mehrlust | 59/79.3 |
| 1,140,445 | A | * | 5/1915 | Collingwood | 245/6 |
| 1,169,735 | A | * | 1/1916 | Salt et al. | 63/15.5 |
| 1,224,921 | A | * | 5/1917 | Hadley | 63/5.1 |
| 2,433,657 | A | * | 12/1947 | Flaig | 59/79.3 |
| 2,457,275 | A | * | 12/1948 | Ritter | 59/79.3 |
| 2,651,909 | A | * | 9/1953 | Kiefer | 59/79.3 |
| 2,667,739 | A | * | 2/1954 | Flaig | 59/79.2 |
| 2,718,750 | A | * | 9/1955 | Spalding | 59/79.2 |
| 3,417,578 | A | * | 12/1968 | Anderson | 63/5.1 |
| 3,683,642 | A | * | 8/1972 | Lutrario | 63/15.45 |
| 3,890,801 | A | * | 6/1975 | Newman | 63/15.65 |
| 4,627,739 | A | * | 12/1986 | Shingo et al. | 368/282 |
| 4,781,705 | A | * | 11/1988 | Shepherd et al. | 604/289 |
| 4,821,533 | A | * | 4/1989 | Bonnefoy | 63/3 |
| 5,036,682 | A | * | 8/1991 | Kennedy | 63/28 |
| 5,412,956 | A | * | 5/1995 | Levy | 63/15.65 |
| 5,419,159 | A | * | 5/1995 | Muller | 63/28 |
| 5,605,059 | A | * | 2/1997 | Woodward | 63/5.1 |
| 6,032,485 | A | * | 3/2000 | Steinberg | 63/15 |
| 6,085,550 | A | * | 7/2000 | Ishida | 63/15.65 |

FOREIGN PATENT DOCUMENTS

| | | | |
|---|---|---|---|
| GB | 4021 | * | 0/1883 |
| GB | 2242112 A | * | 9/1991 |

* cited by examiner

*Primary Examiner*—Jack W. Lavinder
(74) *Attorney, Agent, or Firm*—Christie, Parker & Hale, LLP.

(57) ABSTRACT

An expandable jewelry ring. The ring has a split circular spring made of springy metal and having first and second ends separated by a gap. A tongue portion extends from the first end of the spring and into the gap. A mounting is made of metal and has a generally split circular shape with first and second ends separated by a gap and having a spring channel formed therein. The spring channel has a first portion and a second portion. The spring is positioned in the first portion of the spring channel, with the tongue portion being slideably moveable in the second portion of the spring channel. When pressure from a wearer's finger is exerted on the inside of the mounting, it will expand the effective size of the ring, and when pressure is relieved, the ring will spring back to its original size.

18 Claims, 6 Drawing Sheets

EXPANDABLE RING DESIGN AND METHOD FOR MAKING SAME

BACKGROUND OF THE INVENTION

Rings of precious and non precious stones have been worn by men and women for millennia. And as the price of jewelry has become more affordable over the years, the popularity of so-called eternity rings (rings that have a row of gemstones set around the circumference of the ring), and rings that have gemstones set at least partially around the circumference of the band, has risen. Many ring designs also have elaborate filigree designs and carving around their perimeters. Unlike smooth banded rings, which can be readily resized by stretching, or cutting and filling or removing band material, for eternity rings, this is not possible due to the mounting of the gemstones around the perimeter of the ring. In rings with filigree or designs set around the circumference, resizing a ring can be challenging if maintenance of the integrity of the design is desired.

A tremendous normal variation exists in ring wearers' fingers, which can range in size from 0000 (9.91 mm in diameter) to 13 (22.33 mm in diameter) or even larger, in ⅛ or ¼ increments between sizes. As a result, jewelry manufacturers must manufacture and jewelry retailers stock a large variety of ring sizes to meet the demands of walk-in customers and therefore provide an adequate inventory of rings. This is expensive for both the jewelry manufacturer and jewelry retailer alike since one or both must absorb the costs of unsold merchandise.

Furthermore, many ring wearers, especially women, sometimes experience fluctuations in their finger size. During pregnancy, many women can no longer wear their rings, and sometimes even have to have rings cut off their fingers. Of course, many ring wearers experience body changes and weight fluctuations over weeks, months, and years, which can make ring fitting problematic.

SUMMARY OF THE INVENTION

The invention is an expandable ring design and method for making same. The expandable ring design incorporates a springy and resilient metal loop, which is placed within a channel of a ring body which carries gemstones, particular gemstones around its entire circumference (eternity ring designs) or a large portion of the circumference, rings which have designs formed on their perimeter, and other types of rings for which it is desirable to provide for expandability.

DETAILED DESCRIPTION OF THE INVENTION

Figure 1:
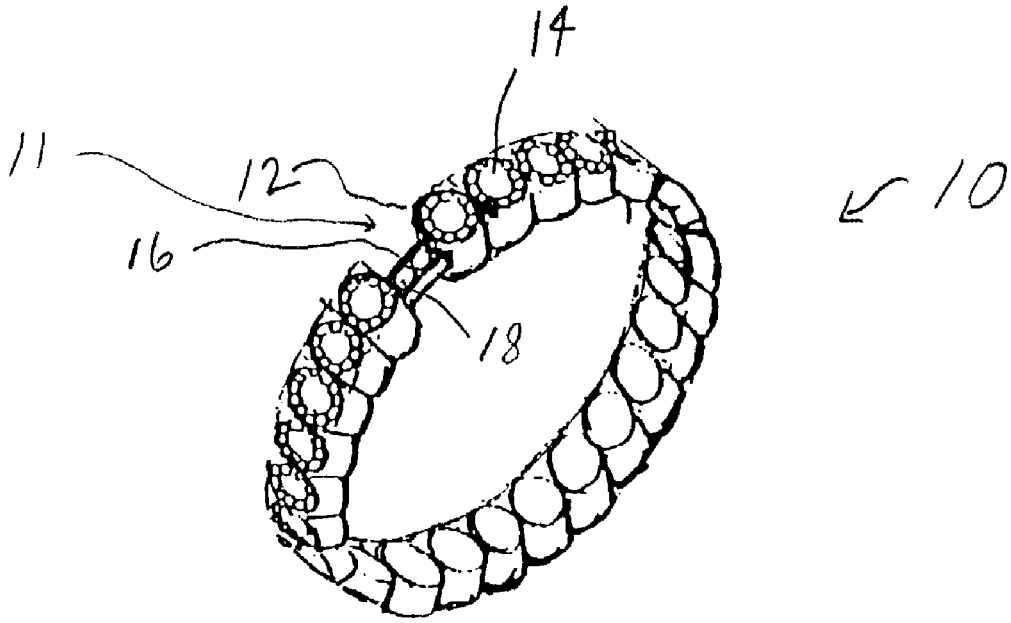
FIG. 1 is a perspective view showing a first embodiment of an expandable ring design of the invention, with the mounting set with a single row of round stones, and having a single spring that is flush mounted with small round gemstones.

FIG. 1 is a perspective view showing a first embodiment of an expandable ring 10 of the invention (in its expanded state with a gap 11), with the mounting 12 set with a single row of round stones 14, and having a single spring 16 that is flush mounted with small round gemstones 18. Normally, the ring will be worn on a wearer's finger with the gap 11 facing palm down.

Figure 2:
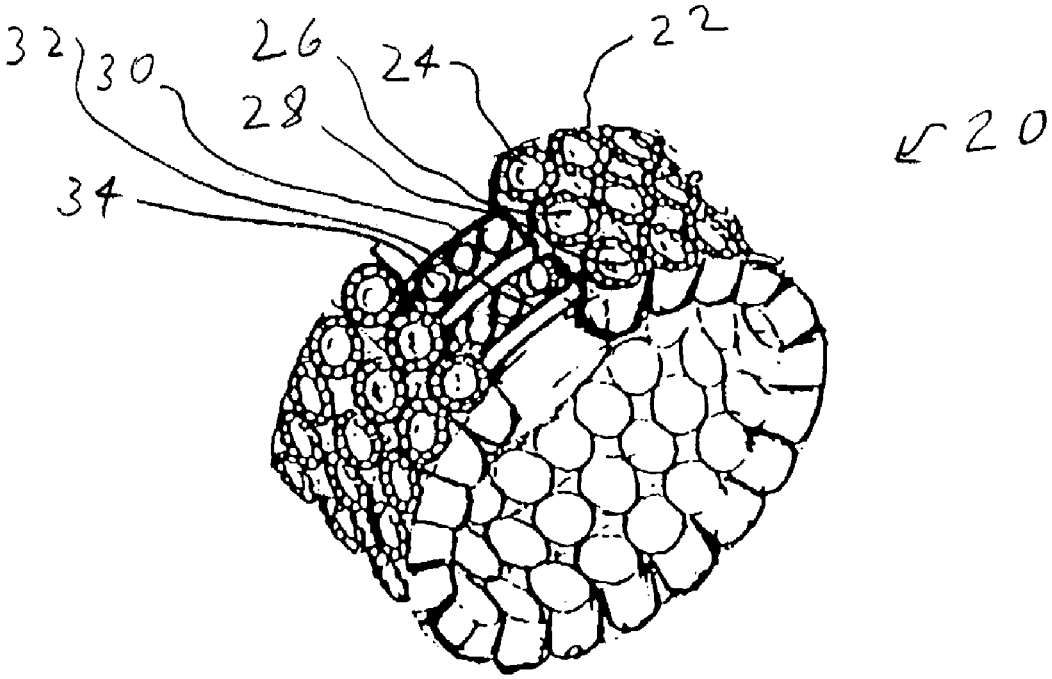
FIG. 2 is a perspective view showing a second embodiment of an expandable ring design of the invention, with the mounting set with three rows of round stones, and having two springs that are set with small round gemstones.

FIG. 2 is a perspective view showing a second embodiment of an expandable ring 20 of the invention (in its expanded state), with the mounting 22 set with three rows of round stones 24, 26 and 28, and having two springs 30 and 32 that are set with small round stones 34.

Figure 3:
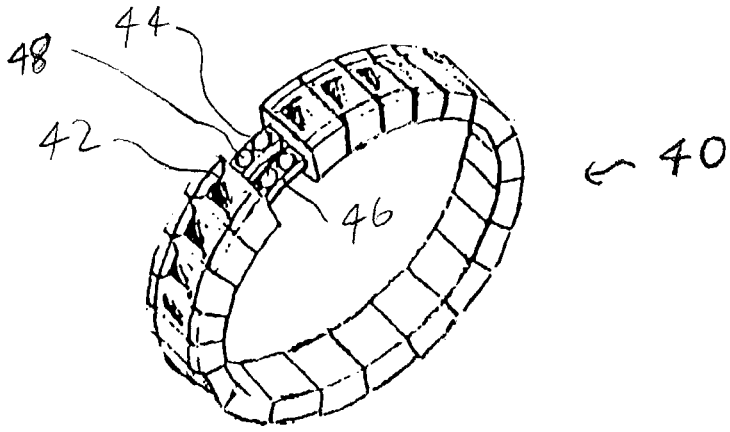
FIG. 3 is a perspective view showing a third embodiment of an expandable ring design of the invention, with the mounting set with a single row of princess stones, and having two springs which are set with small round stones.

FIG. 3 is a bottom perspective view showing a third embodiment of an expandable ring 40 of the invention, with the mounting 40 set with a single row of princess stones 42, and having two springs 44 and 46 that are set with small round stones 48.

Figure 4:
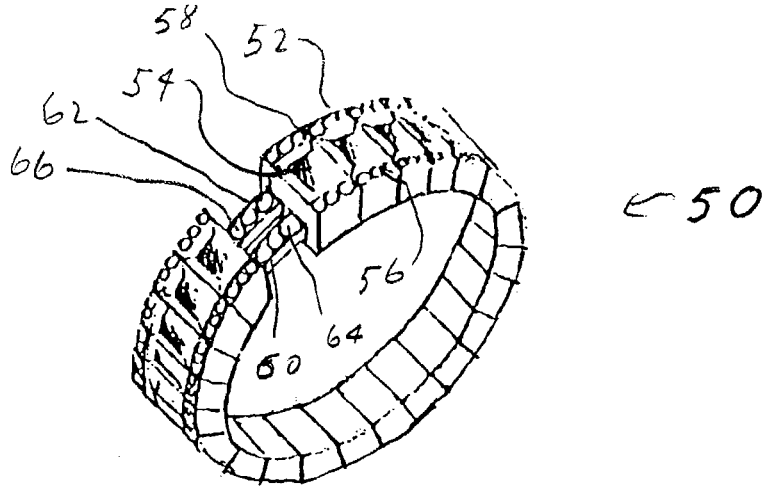
FIG. 4 is a perspective view showing a fourth embodiment of an expandable ring design of the invention, with the mounting set with a single row of center set princess stones and two straddling rows of small round stones, and having two springs that are set with stones.

FIG. 4 is a bottom perspective view showing a fourth embodiment of an expandable ring 50 of the invention, with the mounting 52 set with a single row of center set princess stones 54 and two straddling rows of small round stones 56 and 58 on the sides of the princess stones 54, and having two springs 60 and 62 that are set with small round gemstones 64 and 66.

Figure 5:
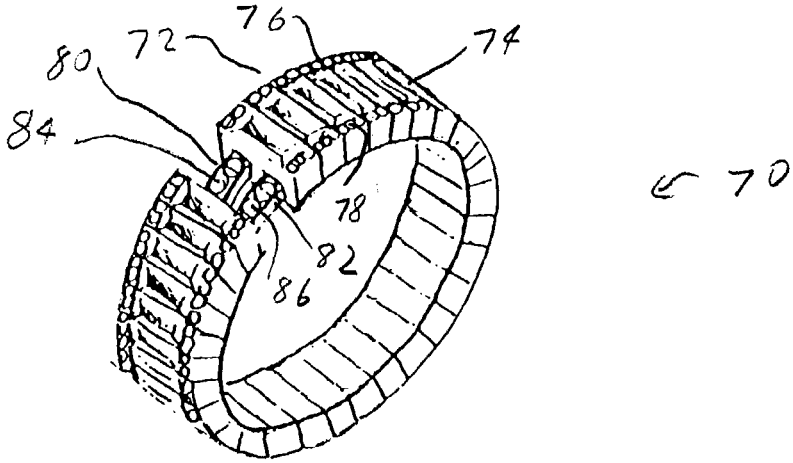
FIG. 5 is a perspective view showing a fifth embodiment of an expandable ring design of the invention, with the mounting set with a single row of center set baguettes and two straddling rows of small round stones, and having two springs that are set with stones.

FIG. 5 is a bottom perspective view showing a fifth embodiment of an expandable ring 70 of the invention, with the mounting 72 set with a single row of center set baguettes 74 and two straddling rows of small round stones 76 and 78 on the sides of the baguettes 74, and having two springs 80 and 82 that are set with small round stones 84 and 86.

Figure 6:
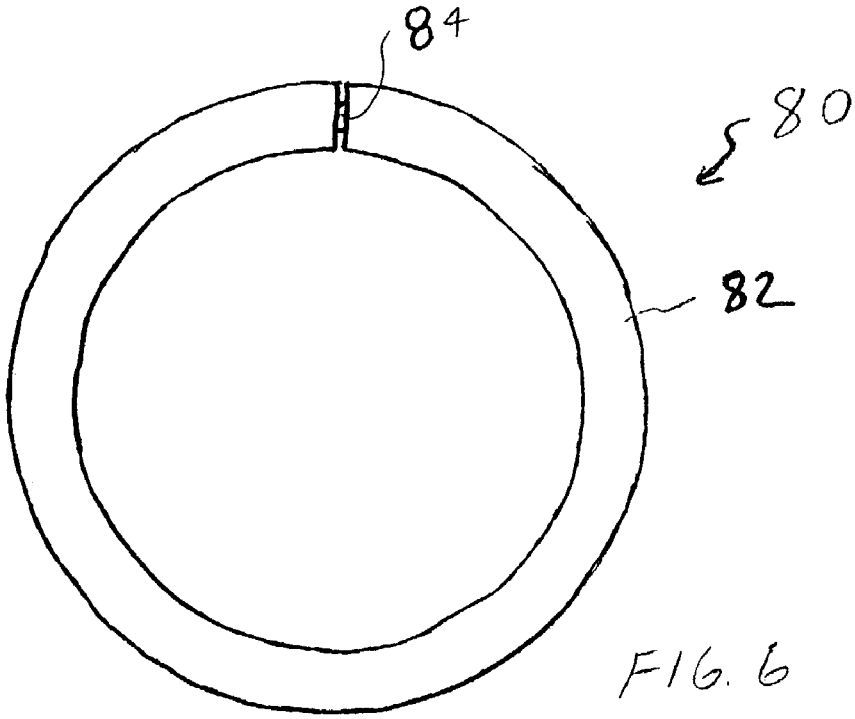
FIG. 6 is a side plan view showing an embodiment of the ring of the invention in an unexpanded state.

FIGS. 6 is a side plan view showing an embodiment of the expandable ring 80 of the invention in an unexpanded state. As can be seen the ring has a mounting portion 82 and a tongue portion 84, which can be seen through a gap 89.

Figure 7:
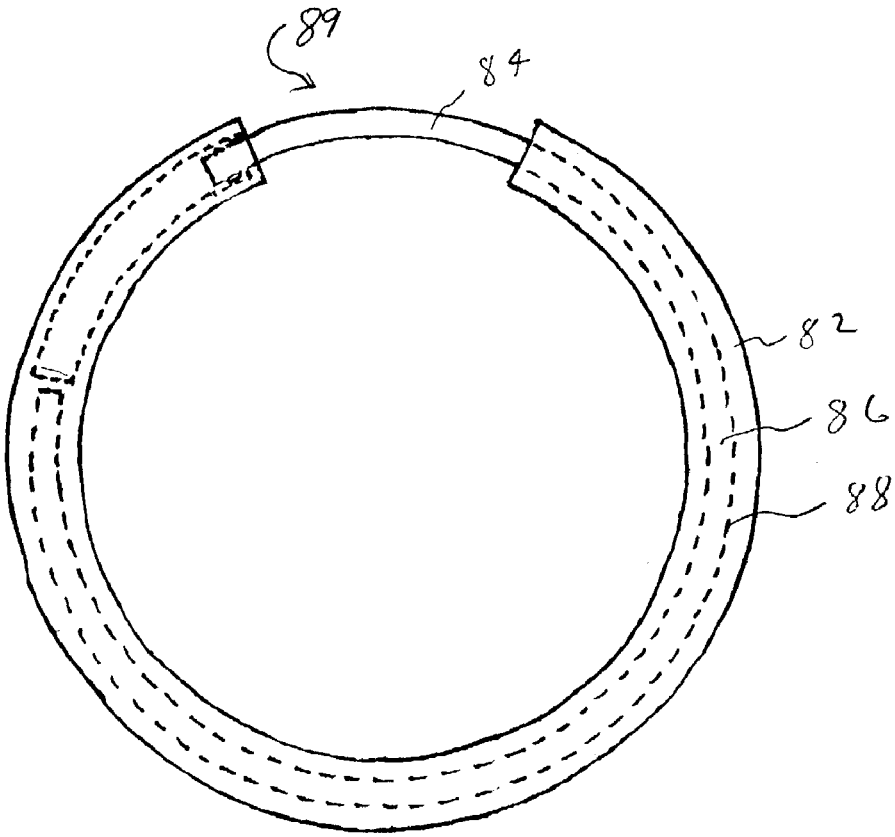
FIG. 7 is a side plan view showing an embodiment of the ring of FIG. 6 in an expanded state, showing the internal spring and spring track in phantom.

Turning to FIG. 7, there is shown a side plan of the ring of FIG. 6, but in an expanded state with the gap 89, showing the split circular spring 86 and spring track or channel 88 in phantom.

Figure 8:
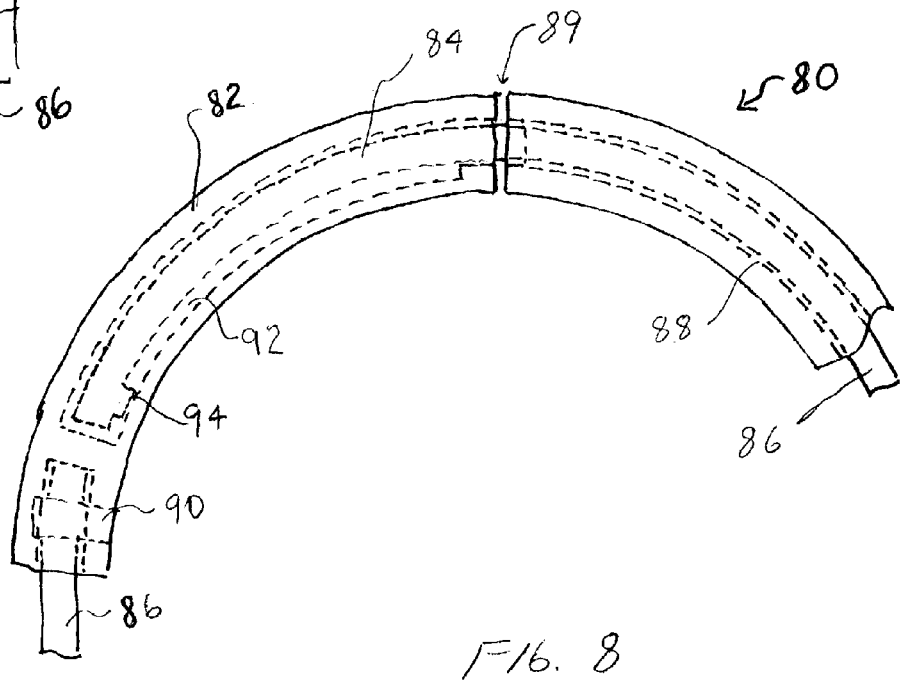
FIG. 8 is a detail showing part of the ring in an unexpanded state in the vicinity of the gap of FIG. 6, and shows the internal track for the spring, the stationary end of the spring being retained.

FIG. 8 is a detail showing a portion of an expandable ring 80 with two springs, in an unexpanded state in the vicinity of the gap 89 of FIG. 6, and shows the internal tracks 88 for the spring 86, and shows the stationary end of the spring being retained with a pivot 90, and the tongue plate 84 retained maximally in a tongue plate channel 92 in the mounting 82. Instead of the pivot 90, the spring can be formed to have a protrusion at its second end or to have an enlarged second end, and the mounting can be formed around the second end to retain it pivotally. A protrusion 94 near the distal end of the tongue plate 84 acts to prevent the tongue 84 from being completely withdrawn from the tongue plate channel 92, as it will impinge on a block 96 in the tongue plate channel, as shown in FIG. 9.

Figure 9:
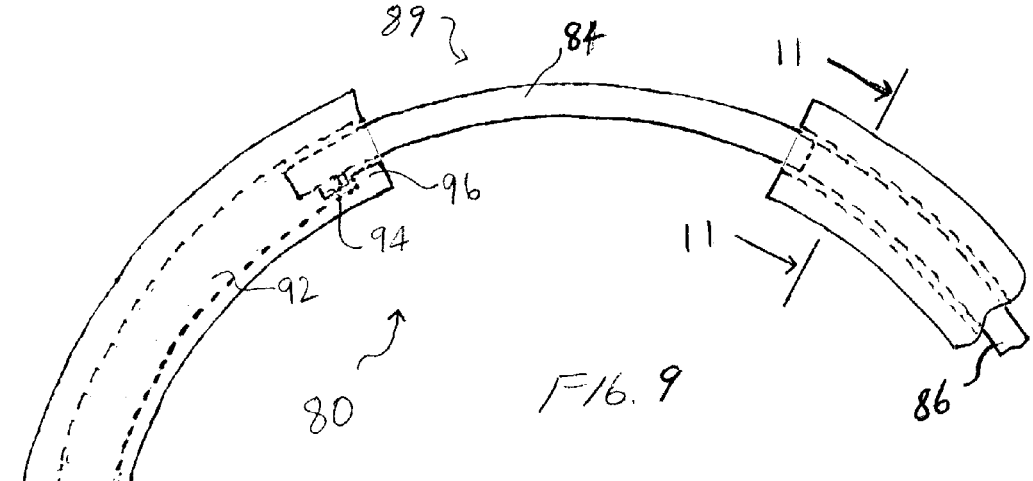
FIG. 9 is a detail showing a portion of the ring in an expanded state in the vicinity of the gap of FIG. 7, and shows the internal track for the spring, the stationary end of the spring being retained, and the tongue plate withdrawn maximally from the tongue plate channel in the mounting.

FIG. 9 is a detail showing part of an expandable ring in an expanded state about the gap 89 of FIG. 7, and shows one internal track 88 for the spring 86, and shows the stationary end of the spring being retained with a pivot 90, and the tongue plate 84 withdrawn maximally from the tongue plate channel 92 in the mounting 82.

Figure 10:
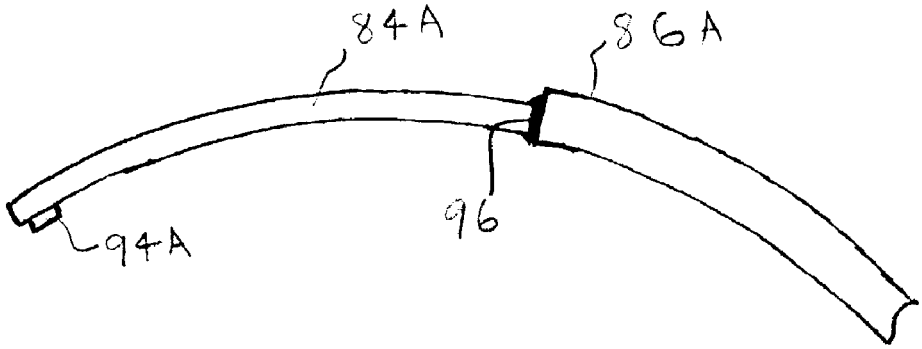
FIG. 10 is a side view of the spring showing the tongue attached to the spring.

FIG. 10 is a detail showing another embodiment of a tongue plate 84 affixed to one end of the spring 86, with a protrusion 94 formed on the distal end of the tongue plate. As is shown, in this embodiment, the tongue plate 84 is thinner than the spring 86 and is soldered at their interface 96.

Figure 11:
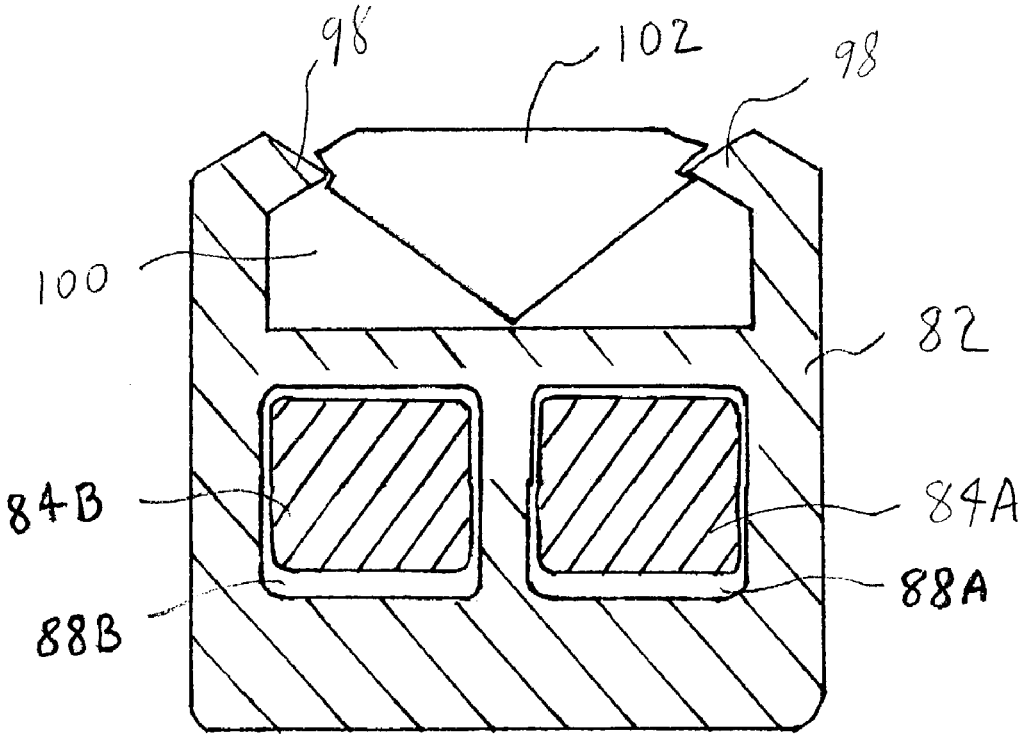
FIG. 11 is a cross-sectional view along view lines 11—11 of FIG. 9.

FIG. 11 is a cross-sectional view of the expandable ring of FIG. 9 along view lines 11—11 of FIG. 9, and shows the two springs 84A and 84B in their two channels 88A and 88B, with prongs 98 retaining a stone 102 to the mounting 82.

Figure 12:
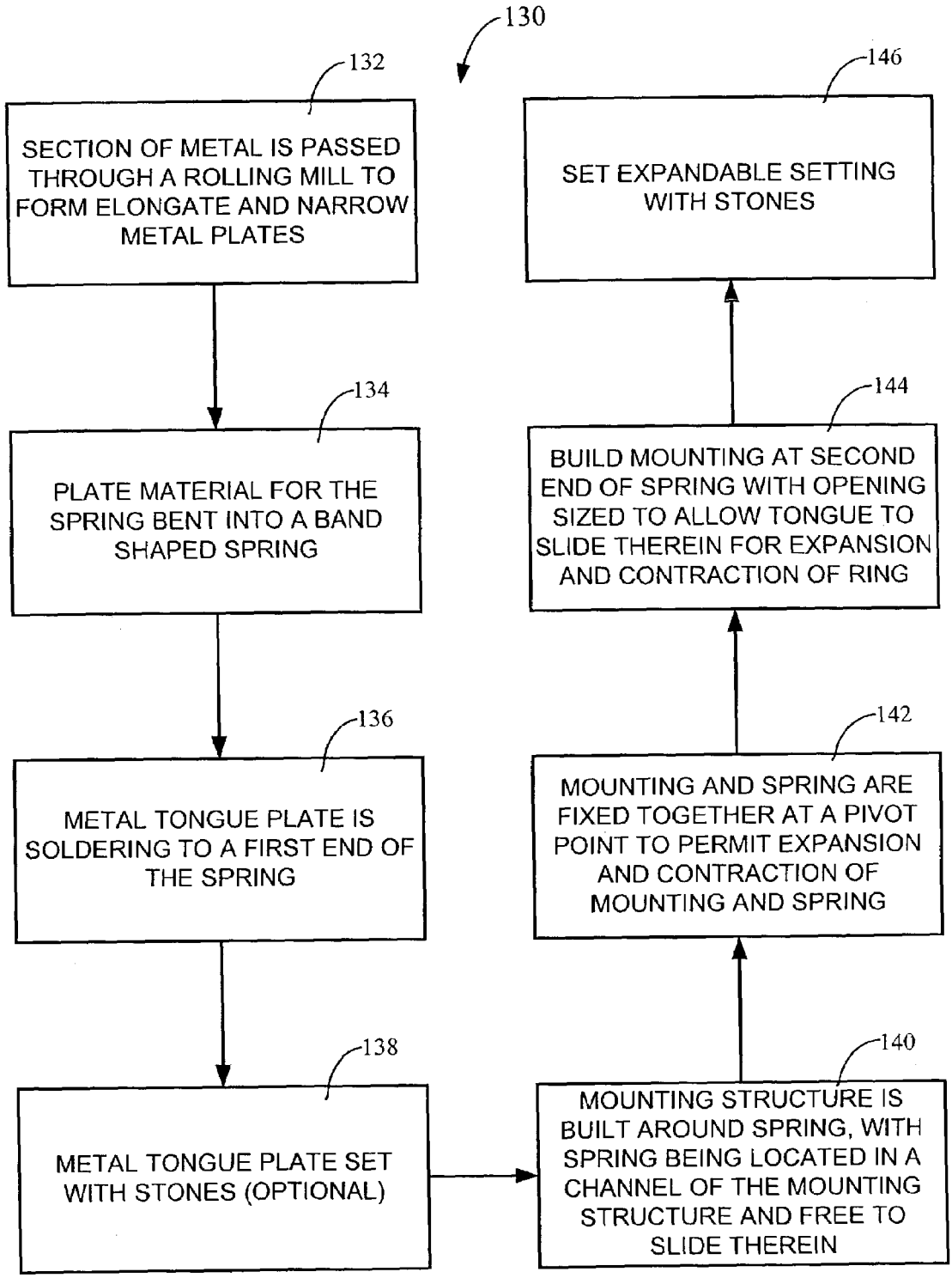
FIG. 12 is a flowchart showing an embodiment of the steps followed to form the expandable ring of the invention.

Turning to FIG. 12, there is shown a flowchart 130 showing the steps used to manufacture expandable rings in accordance with the invention. In the method of the invention, in step 132 a section of metal, such as gold, e.g., 5 mm thick square-thread gold, is passed through a rolling mill several times to form elongate and narrow metal plates. The metal plates thus formed become elongated and narrower, according to the width of the final spring desired, and the thickness of the plate desired. Annealing the metal may be necessary after it has been passed through the mill a few times. In embodiments using two springs, this step is used to produce two elongate plates.

The elongate plate formed as described is of a desired thickness and width, according to the requirements of the final ring design. For example, a narrower ring design (which may require a narrower spring) may require a thicker plate to maintain a desired degree of spring resilience. A desired length of the plate can be cut from the plate material, for example, between 5.5 cm and 7.0 cm, but more typically about 6.5 cm for average ring sizes. For smaller and narrower ring sizes, the plate thickness can be thicker, and for larger and wider ring sizes, the plate thickness can be made slightly thinner. The inventor has found that the spring can be made of yellow or white gold since yellow or white gold provides a good amount of resilience. On the other hand, silver and platinum, do not provide as much resilience and are not ideal materials for the spring.

In step 134, after forming the plate material for the spring, the spring is bent into a band shape, with the first and second ends of the plates spaced apart with a gap spacing. A mandrel or other known means can be used to form the band-shaped spring.

Thereafter, in step 136, a metal tongue plate with holes preferably formed therein is soldered to a first end of the spring. A first hole is preferably formed near the junction of the tongue plate and the first end of the spring. Alternately, the first hole can be formed through the first end of the spring. A second hole is preferably near the distal end of the tongue plate. The tongue plate can be the same or of different materials than the spring, but it is preferably that the tongue plate be made of the same material as the spring, e.g. white or yellow gold. The tongue plate is arched to have the same curvature as the band, and this will be the part of the spring that is visible when the ring expands. In an optional step 138, the tongue plate can be set with gemstones and be engraved or have a pattern, if desired. One of the features of the expandable rings of the invention is that any optional settings that may be placed in the tongue must be made low so as to allow the tongue to fit into the groove. If the tongue plate is to be set with gemstones, this must be carried out before continuing with the forming of the rest of the structure of the ring, and the tongue must be set before being inserted into the mounting. If the ring design will be one having two springs, two tongue plates are made and are attached to the two springs. The spring can be cut to form two or more tongues if desired, where the tongues are part of the spring, and can be cut and rounded or otherwise finished as desired.

In step 140, the jeweler builds the structure of the ring, namely the mounting structure, all around the spring or springs, with the spring being located in a tunnel of the mounting structure and free to slide within the tunnel. The mounting structure will vary depending upon the type of setting chosen (e.g. channeled, hammered, bezels, etc.), and the types of gemstones which will be set (i.e. princess, tapers, baguettes, round gemstones, etc.)

After the mounting is built, in step 142, the jeweler fixes the mounting and the spring together at a pivot point, preferably located in the vicinity of the first end of the spring. For example, a pin can be inserted through the mounting into the first hole. This fixes the spring and mounting together, yet permits expansion and contraction of the mounting and spring.

In step 144, the jeweler then continues with building of the mounting by adding a mounting extension portion at the second end of the spring to extend around the tongue plate with an opening that is sized to allow the tongue plate (and any tongue plate mountings formed thereon) to freely slide in and out therein to permit the ring to expand. A protrusion is fixed near the distal end of the tongue plate, which protrusion is sized and shaped such as to prevent the tongue plate from being completely pulled out of the open end of the mounting extension portion. The protrusion can comprise a pin and the like. Alternately, the tongue plate can be formed with an enlarged distal end to accomplish the same purpose. In lieu of the step of adding a mounting extension portion at the second end of the spring to extend around the tongue plate with an opening, the mounting extension portion can be formed at the same the mounting is built around the spring.

Lastly, in step 146, the gemstones can be set in the mountings, and, if applicable, in any mountings on the tongue plate.

Table 1 below gives the standard U.S. ring sizes. The differences in diameter between rings sizes is generally between 0.81 mm and 0.84 mm, and the differences in circumference is generally about 2.54 mm and 2.64 mm per whole size change.

| U.S. Ring Size | Diameter (mm) | Circumference (mm) |
|---|---|---|
| 1 | 12.37 | 38.861592 |
| 2 | 13.21 | 41.4794 |
| 3 | 14.05 | 44.117 |
| 4 | 14.86 | 46.6604 |
| 5 | 15.70 | 49.298 |
| 6 | 16.51 | 51.8414 |
| 7 | 17.35 | 54.479 |
| 8 | 18.19 | 57.1166 |
| 9 | 18.89 | 59.3146 |
| 10 | 19.84 | 62.2976 |
| 11 | 20.68 | 64.9352 |
| 12 | 21.49 | 67.4786 |
| 13 | 22.33 | 70.1162 |

To provide for an increase of up to three ring sizes, the tongue plate is sized to have a travel of about 7 mm to 8 mm, and accordingly, the tongue plate is selected to have a length that is greater than this. Of course, by selected shorter travels, the range of expandability can be made less. Furthermore, the thickness, stiffness and other characteristics of the material used, and construction of the mountings around the spring can influence the degree to which the mounting can safely be expanded without compromising its integrity, and therefore avoid breakage of the mounting and/or spring.

The present invention covers the modifications and variations of this invention provided they come within the scope of the appended claims and their equivalents. In this context, equivalents mean each and every implementation for carrying out the functions recited in the claims, even those not explicitly described herein.

What is claimed is:

1. An expandable jewelry finger ring, comprising:

a split circular spring made of resilient material and having a first end and a second end, the first and second ends separated by a single circumferential spring gap;

a tongue portion extending from the first end of the spring and into the single spring gap; and a one-piece mounting which is made of resilient material and has a generally split circular shape with a first end and a second end separated by a single circumferential gap, a spring channel formed in the mounting, the spring channel having a first portion and a second portion, wherein the spring is positioned in the first portion of the spring channel, the tongue portion being slideably moveable in the second portion of the spring channel and having a stop for preventing the tongue portion from being completely withdrawn from the second portion of the spring channel, wherein when pressure is placed on an inside surface of the mounting, the jewelry finger ring will expand circumferentially from a first configuration where the first end and the second end of the mounting are separated by a first smaller circumferential gap, to a second configuration where the first end and the second end of the mounting are separated by a second larger circumferential gap to increase the diameter of the jewelry finger ring, and when pressure is removed, will contract back to a smaller size.

2. The expandable jewelry finger ring of claim 1, wherein the mounting and spring are formed of precious metal.

3. The expandable jewelry finger ring of claim 1, wherein the spring and tongue portion are formed of annealed strips of gold.

4. The expandable jewelry finger ring of claim 1, wherein two spring channels are formed in the mounting, and are sized to receive two springs and two tongue portions therein.

5. The expandable jewelry finger ring of claim 1, wherein the jewelry ring is an eternity ring mounting having settings for supporting gemstones on the mounting.

6. The expandable jewelry finger ring of claim 1, wherein the ring is expandable by up to three standard finger ring sizes between its first configuration and its second configuration.

7. The expandable jewelry finger ring of claim 1, wherein the spring is affixed near its second end to the mounting to allow expansion and contraction of the mounting as the mounting is expanded by wearing on a user's finger.

8. An expandable jewelry ring, comprising:

a split circular spring made of resilient material and having a first end and a second end, the first and second ends separated by a single spring gap;

a tongue portion extending from the first end of the spring and into the single spring gap, wherein the tongue portion has settings for mounting gemstones thereon; and a one-piece mounting which is made of resilient material and has a generally split circular shape with a first end and a second end separated by a single gap, a spring channel formed in the mounting, the spring channel having a first portion and a second portion, wherein the spring is positioned in the first portion of the spring channel, the tongue portion being slideably moveable in the second portion of the spring channel and having a stop for preventing the tongue portion from being completely withdrawn from the second portion of the spring channel, wherein when pressure is placed on an inside surface of the mounting, the jewelry ring will expand from a first configuration where the first end and the second end of the mounting are separated by a first smaller gap, to a second configuration where the first end and the second end of the mounting are separated by a second larger gap to increase the diameter of the jewelry ring, and when pressure is removed, will contract back to a smaller size.

9. An expandable jewelry finger ring mounting for mounting with gemstones, comprising:

a split circular spring made of precious metal and having a first end and a second end, the first and second ends separated by a circumferential spring gap; and a one-piece mounting comprising precious metal and having a generally split circular shape with a first end and a second end separated by a single circumferential mounting gap, settings for supporting gemstones on the mounting, a spring channel formed in the mounting, the spring channel having a first portion and a second portion, wherein the spring is positioned in the first portion of the spring channel with the second end of the spring being slideably moveable in the second portion of the spring channel and having a stop for preventing the second end of the spring from being completely withdrawn from the second portion of the spring channel, wherein when pressure is placed an inside surface of the mounting, the jewelry finger ring will expand circumferentially from a first configuration where the first end and the second end of the mounting are separated by a first smaller circumferential gap, to a second configuration where the first end and the second end of the mounting are separated by a second larger circumferential gap to increase the diameter of the jewelry finger ring, and when pressure is released, will reduce the diameter of the jewelry ring.

10. The expandable jewelry finger ring of claim 9, wherein two spring channels are formed in the mounting, and are sized to receive two springs and two tongue portions therein.

11. The expandable jewelry finger ring of claim 9, wherein the finger ring is an eternity finger ring mounting.

12. The expandable jewelry finger ring of claim 9, wherein the spring is affixed near its second end to the mounting to allow circumferential expansion and contraction of the mounting as the mounting is expanded by wearing on a user's finger.

13. An expandable jewelry ring mounting for mounting with gemstones, comprising:

a split circular spring made of precious metal and having a first end and a second end, the first and second ends separated by a spring gap;

a tongue portion attached to the first end of the spring which tongue portion has settings for mounting gemstones thereon; and a one-piece mounting comprising precious metal and having a generally split circular shape with a first end and a second end separated by a single mounting gap, settings for supporting gemstones on the mounting, a spring channel formed in the mounting, the spring channel having a first portion and a second portion, wherein the spring is entirely positioned in the first portion of the spring channel with the second end of the spring being slideably moveable in the second portion of the spring channel and having a stop for preventing the second end of the spring from being completely withdrawn from the second portion of the spring channel, wherein when pressure is placed an inside surface of the mounting, the jewelry ring will expand from a first configuration where the first end and the second end of the mounting are separated by a first smaller gap, to a second configuration where the first end and the second end of the mounting are separated by a second larger gap to increase the diameter of the jewelry ring, and when pressure is released, will reduce the diameter of the jewelry finger ring.

14. An expandable jewelry finger ring, comprising:

a split circular spring made of resilient material and having a first end and a second end, the first and second ends separated by a single spring gap;

a tongue portion fixed to and extending from the first end of the spring and into the spring gap towards the second end of the spring; and a single-piece mounting comprising resilient material and having a generally split circular shape with a first end and a second end separated by a single circumferential mounting gap, and a spring channel formed in the mounting, wherein the split circular spring is entirely positioned in the spring channel and the tongue portion extends across the mounting gap between the first and second ends of the mounting and back into the spring channel.

15. The expandable jewelry finger ring of claim 14, wherein the jewelry ring has mountings for supporting gemstones around a perimeter of jewelry finger ring.

16. An expandable jewelry ring, comprising:

a split circular spring made of resilient material and having a first end and a second end, the first and second ends separated by a single spring gap;

a tongue portion extending from the first end of the spring and into the spring gap towards the second end of the spring, wherein the tongue portion has mountings for mounting gemstones thereon; and a single-piece mounting comprising resilient material and having a generally split circular shape with a first end and a second end separated by a single mounting gap, and a spring channel formed in the mounting, wherein the split circular spring is positioned in the spring channel and the tongue portion extends across the mounting gap between the first and second ends of the mounting and back into the spring channel.

17. An expandable jewelry finger ring mounting for mounting with gemstones, comprising:

a split circular spring made of resilient material and having a first end and a second end, the first and second ends separated by a circumferential spring gap; and a single-piece, non-hinged together mounting comprising metal and having a generally split circular shape with a first end and a second end separated by a circumferential mounting gap, settings for supporting gemstones on the mounting, and a spring channel formed in the mounting, wherein the spring is at least partially slideably positioned in the spring channel and extends across the circumferential mounting gap and back into the spring channel.

18. The expandable jewelry finger ring of claim 17, wherein the jewelry ring has mountings for supporting gemstones around the entire perimeter of jewelry ring to form an expandable eternity finger ring.

* * * * *